US005613808A

United States Patent [19]

Fitzpatrick

[11] Patent Number: 5,613,808

[45] Date of Patent: Mar. 25, 1997

[54] STEPPED STEEL GRAVITY PLATFORM FOR USE IN ARCTIC AND SUBARCTIC WATERS

[75] Inventor: Patrick J. Fitzpatrick, Calgary, Canada

[73] Assignee: Amoco Corporation, Chicago, Ill.

[21] Appl. No.: 404,430

[22] Filed: Mar. 15, 1995

[51] Int. Cl.[6] ..... E02B 17/00

[52] U.S. Cl. ..... 405/217; 405/204; 405/203

[58] Field of Search ..... 405/217, 203, 405/204, 195.1, 211

[56] References Cited

U.S. PATENT DOCUMENTS

| | | | |
|---|---|---|---|
| 3,490,406 | 1/1970 | O'Reilly et al. | 114/5 |
| 3,692,205 | 9/1972 | Cowles et al. | 220/9 |
| 3,757,982 | 9/1973 | Isenberg et al. | 220/9 |
| 4,187,039 | 2/1980 | Jahns et al. | 405/217 |
| 4,239,418 | 12/1980 | Pearce | 405/211 |
| 4,260,292 | 4/1981 | Steddum et al. | 405/217 |
| 4,325,655 | 4/1982 | Jahns et al. | 405/217 |
| 4,386,872 | 6/1983 | Smith | 405/13 |
| 4,422,804 | 12/1983 | Gerwick et al. | 405/210 |
| 4,427,320 | 1/1984 | Bhula et al. | 405/211 |
| 4,470,725 | 9/1984 | Kure et al. | 405/212 |
| 4,479,742 | 10/1984 | Bruce | 405/217 |
| 4,537,532 | 8/1985 | Chen et al. | 405/217 |
| 4,639,167 | 1/1987 | Petty et al. | 405/217 |
| 4,655,642 | 4/1987 | Birdy et al. | 405/217 |
| 4,784,526 | 11/1988 | Turner | 405/204 |
| 4,808,036 | 2/1989 | Bhalaik et al. | 405/217 |
| 4,906,138 | 3/1990 | Barbaras et al. | 405/211 |
| 5,044,830 | 9/1991 | Barbaras et al. | 405/210 |
| 5,069,318 | 12/1991 | Kulesha et al. | 188/377 |
| 5,083,523 | 1/1992 | Osborne-Moss et al. | 114/256 |
| 5,186,581 | 2/1993 | Ngoc et al. | 405/217 |
| 5,316,413 | 5/1994 | Sisodiya et al. | 405/217 |
| 5,383,748 | 1/1995 | Waddell | 405/217 |

FOREIGN PATENT DOCUMENTS

| | | |
|---|---|---|
| 1081483 | 7/1980 | Canada . |
| 2562112 | 4/1984 | France . |
| 61-28626 | 2/1986 | Japan . |
| 130516 | 6/1986 | Japan . |
| 244910 | 10/1987 | Japan . |
| 1682465 | 10/1991 | U.S.S.R. . |
| 2010366 | 12/1978 | United Kingdom . |
| 00277 | 5/1986 | WIPO . |

OTHER PUBLICATIONS

T, Sarpkaya et al., "Mechanics of Wave Forces on Offshore Structures", pp. 160–163 and 381–397, New York, Van Nostrand Co, 1981.

*Primary Examiner*—Dennis L. Taylor

*Attorney, Agent, or Firm*—Charles P. Wakefield; Robert E. Sloat

[57] ABSTRACT

An offshore structure is disclosed for placement on a sea floor foundation located in a body of water containing moving ice masses and water waves. The offshore structure has a foundation base which contacts the sea floor foundation and at least three stepped stages which are stacked above the foundation base. Each stage has an outer hull to engage moving ice masses and water waves. Additionally, each stage has an outer horizontal diameter which is smaller than the outer horizontal diameter of the stage immediately below it.

21 Claims, 7 Drawing Sheets

STEPPED STEEL GRAVITY PLATFORM FOR USE IN ARCTIC AND SUBARCTIC WATERS

FIELD OF THE INVENTION

The present invention relates to an offshore structure for use in arctic and sub-arctic locations. More particularly, the invention relates to an offshore stepped stage gravity structure which may be operated where large ice masses may be encountered.

BACKGROUND OF THE INVENTION

In order to operate in the ice infested waters of the arctic and sub-arctic, offshore platforms must be able to resist forces which act on the platforms as a result of wind, water waves, water currents, and moving ice masses. The forces acting on an offshore platform which are a result of such environmental effects are hereinafter collectively referred to as "Environmental Loads." The outer hull of an offshore platform must be designed so that it can withstand the local action of the Environmental Loads on the outer hull which may develop as a result of ice masses or water waves impinging on the hull. Additionally, an offshore platform must have a large enough base contact area with the sea floor foundation and enough mass to prevent slippage between the base and the foundation and to prevent the bearing capacity of the foundation from being exceeded, and to prevent an overturning moment which develops as a result of the Environmental Loads from overturning the platform.

In the past, it was believed that the major Environmental Loads acting on such a platform resulted from moving ice masses impinging on the structure. Therefore, in the past the limiting factor in the design of an offshore structure was whether it could resist the Environmental Loads which resulted from the impingement of large moving ice masses on its outer hull. This resulted in massive offshore structure designs which were designed to resist the Environmental Loads which were believed to result from the impingement of large ice masses on an offshore structure.

For example, U.S. Pat. No. 4,422,804 to Gerwick, Jr., et al. discloses an offshore structure which is designed to be operated in arctic waters where icebergs may be present. Gerwick, Jr., et al. disclosed a platform that has an array of vertically extending scallop shaped ballast compartments which form the outer periphery of the platform. The platform generally has the shape of a cylinder and is preferably constructed of concrete. While the platform design disclosed by Gerwick, Jr., et al. will be effective for operating in arctic ice infested waters, it is believed that it is overbuilt for the actual Environmental Loads which will result from ice masses that may be encountered in most offshore areas. Further, the generally cylindrical shape of the platform will increase the Environmental Loads which will act on the platform as a result of water waves.

Another example of a design that may be used in arctic waters where large moving ice masses may be encountered is disclosed in U.S. Pat. No. 4,639,167 to Petty, et al. The platform disclosed in Petty, et al. has external walls that am angled away from the vertical. These sloped external walls were intended to bend the ice from the horizontal and make it ride up the walls until it broke in flexure. While this design may work for failing ice in flexure, it is believed that this type of design will also result in a platform that is improperly sized for the actual Environmental Loads which will result from ice masses that can be expected to be encountered in most offshore areas.

What is desired is an offshore structure design that Will withstand the Environmental Loads that result from moving ice masses, but that will minimize the Environmental Loads that are a result of other environmental effects such as water waves and water currents. This will result in a design that is more economical and easier to build than currently existing offshore structure designs intended for ice infested waters.

SUMMARY

It has been unexpectedly discovered that an offshore stepped stage gravity structure can be deployed in the arctic and sub-arctic regions of the world which will withstand the Environmental Loads created by moving ice masses and will also minimize the Environmental Loads which result from such environmental factors as water waves. The structure is preferably constructed of arctic grade steel. The stepped stage design of the structure will greatly reduce the amount of steel which is required to build the structure. This reduction in the amount of material required will reduce the costs of recovering hydrocarbons from reservoirs lying beneath an offshore structure and thereby lower the field threshold size, from which hydrocarbons can economically be recovered.

In a first embodiment of the invention, an offshore structure is disclosed for placement on a sea floor foundation in a body of water containing moving ice masses and water waves, which impart Environmental Loads to the structure, the structure comprising:

a foundation base which contacts the sea floor foundation, the foundation base having sufficient horizontal cross-sectional area such that a bearing pressure and a horizontal shear force, which result from the Environmental Loads and which are transferred to the sea floor foundation by the foundation base, are less than at least one of a predetermined shear capacity and a predetermined bearing capacity for the sea floor foundation; and at least three stepped stages stacked above the foundation base, each stage having an outer hull to engage the ice masses and each stage having a smaller outer diameter than the stage immediately below it, the structure having a sufficient mass to prevent an overturning moment, which results from the Environmental Loads, from overturning the structure.

In a second embodiment of the invention, a stepped stage gravity platform is disclosed for placement on a sea floor foundation in a body of water containing moving ice masses and water waves, the platform comprising:

a deck located above a waterline of the body of water; and a floatable substructure for supporting the deck, the substructure comprising:

a lowermost first stage having an outer diameter of from about 100 to about 150 meters and having a lower end forming a foundation base, which contacts the sea floor foundation;

a second stage stacked above the first stage, the second stage having an outer diameter of from about 20 to about 50 meters less than the outer diameter of the first stage; and a third stage stacked above the second stage, the third stage having an outer diameter of from about 10 to about 30 meters less than the outer diameter of the second stage.

In some aspects of the invention, the stages are sized so that the average wave load per vertical meter run on the outer hull of the first stage located completely below the waterline is approximately equal to the average wave load per vertical meter run on the outer hull of the stage located immediately below it. In all aspects of the invention, if the horizontal cross-section of a stage does not form a circle, then the outer diameter is defined by the largest circle which can be formed within the horizontal cross-section of the stage.

DESCRIPTION OF THE PREFERRED EMBODIMENTS

Figure 1:
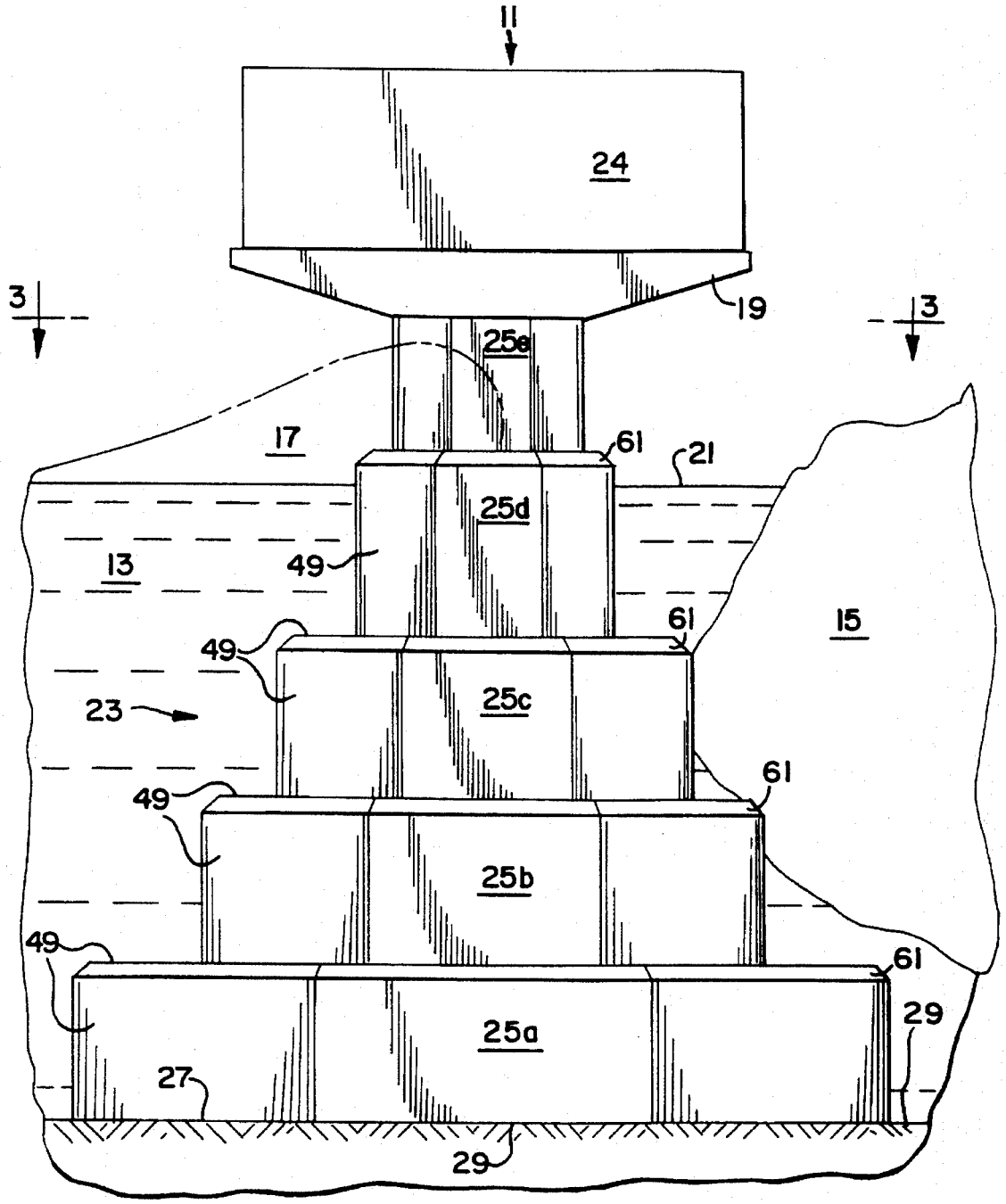
FIG. 1 is a perspective side view of a stepped stage gravity structure shown placed on a sea floor foundation.

While this invention is susceptible of embodiment in many different forms, there is shown in the drawings, and will herein be described in detail, specific embodiments of the invention. It should be understood, however, that the present disclosure is to be considered an exemplification of the principles of the invention and is not intended to limit the invention to the specific embodiments illustrated.

Briefly referring to FIG. 1, the present invention is a stepped stage gravity structure 11 to be used in a body of water 13 that contains moving ice masses 15 and water waves 17. Structure 11 has a deck 19, which is located above the waterline 21, and a substructure 23, which supports deck 19. Substructure 23 preferably has at least 3 stepped stages 25 (stages 25 *a, b, c, d,* and *e* shown in FIG. 1 ). The lowermost stage 25*a* has the largest outer horizontal diameter and has a foundation base 27 at its lower end. Foundation base 27 is designed to be placed on and contact a sea floor foundation 29. Foundation base 27 preferably is comprised of steel plates 28 which are preferably welded together. Foundation base 27 has a large enough base contact area with sea floor foundation 29, so that the Environmental Loads, which may act on the structure 11 do not create a bearing pressure or a horizontal Shear force, which could exceed the horizontal shear capacity or the bearing capacity of sea floor foundation 29. The horizontal shear capacity and the bearing capacity of a typical sea floor foundation 29 can be determined by methods known to one of ordinary skill in the art.

Additionally, foundation base 27 should be large enough and structure 11 should have enough mass so that an overturning moment, which results from the Environmental Loads, can not overturn structure 11.

Stepped stages 25 are of appropriate size to reduce the Environmental Loads which result from water waves 17 impinging on structure 11, while at the same time being constructed to withstand the Environmental Loads which result from a design moving ice mass 15 impinging on substructure 23. This type of design will reduce the total Environmental Loads which structure 11 must withstand, thereby reducing the size of the structure 11 and the amount of material which must be used to construct it.

Figure 8:
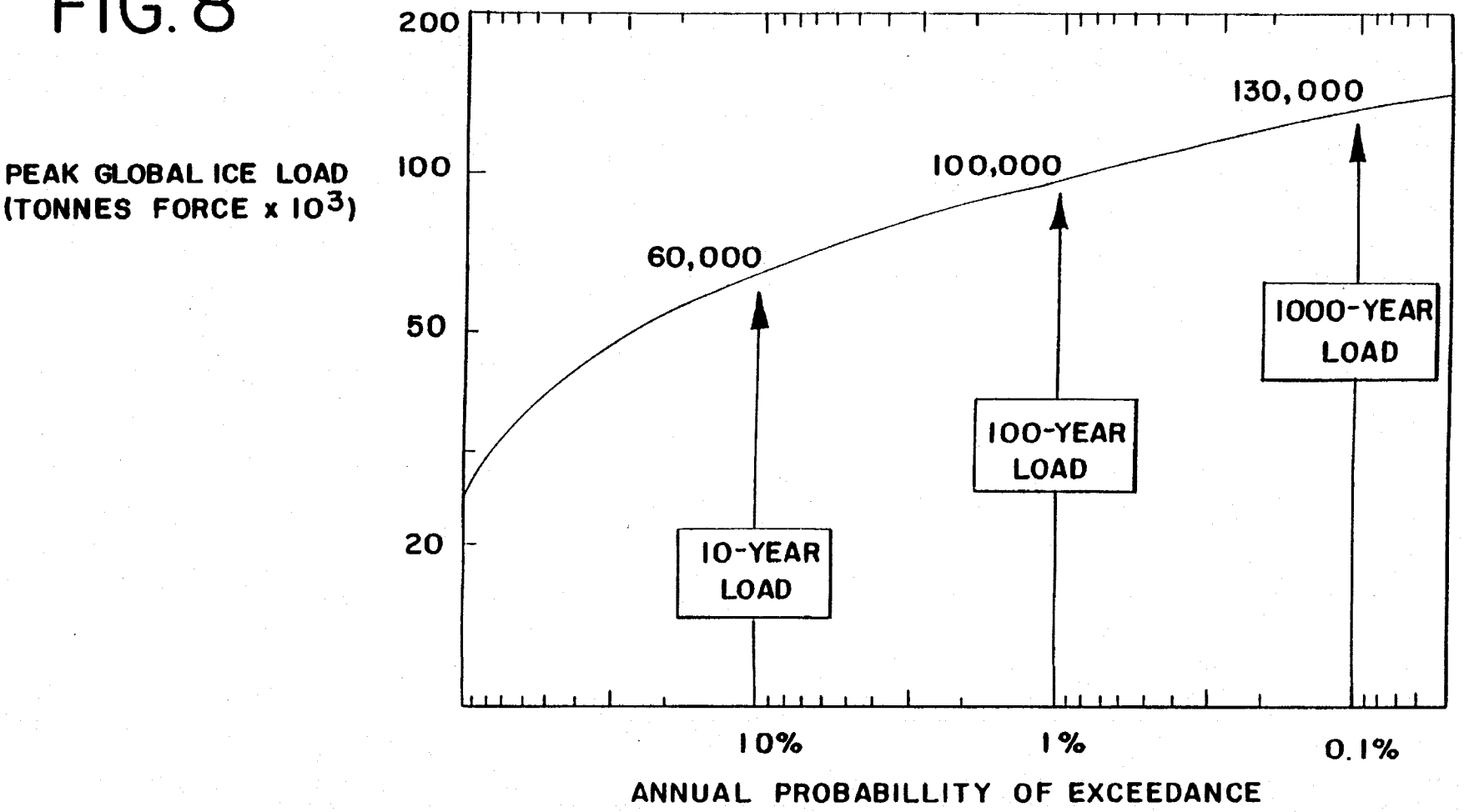
FIG. 8 is a graph showing the design global ice load curve for a monolithic gravity structure having an outer diameter of 100 meters, which is located in the United States or Canadian Beufort Sea.

It would be impractical to build structure 11 to withstand all potential Environmental Loads. Preferably, statistical probability analysis is used to develop probability distribution relationships for the major Environmental Loads which may be imparted to structure 11. Typically, the probability distribution relationships are plotted on graphs, which have peak Environmental Loads on one axis and annual probability of exceedance on the other axis. This results in a design Environmental Load curve. The design Environmental Load for any given risk level can be determined from such graphs. An example of a design Environmental Load curve is shown in FIG. 8, which shows the design global ice load which can be expected for a monolithic gravity structure which is 100 meters across and 100 meters tall and which is located in the Canadian Or U.S. Beufort Sea.

Preferably, structure 11 is designed to withstand a 10-year design Environmental Load, and more preferably a 100-year design Environmental Load. A 100-year design Environmental Load corresponds to the peak Environmental Load from the design Environmental Load curve for an annual probability of exceedance of 1%. For example, the 100-year design Environmental Load for the global ice load shown in FIG. 8 is equal to 100,000 tonnes force. Additionally, when designing structure 11, a safety factor is incorporated into the design of structure 11. Typically, a safety factor of between 1.1 and 1.5 is utilized in designing structure 11. Preferably, a safety factor of 1.5 is utilized in designing structure 11.

Structure 11 is designed so that it can withstand the design Environmental Loads which result from either moving ice masses and water waves (i.e., design global ice loads and design water wave loads), however, it is assumed in the design of structure 11 that the Environmental Loads which result from moving ice masses and water waves will not occur simultaneously.

Structure 11 is shown in FIG. 1 with working equipment 24 installed. If desired, a second working deck can be constructed above deck 19.

Preferably, each stage 25 has the shape of a octagon when viewed from above. It is believed that a stage 25 shaped like an octagon will reduce the maximum load that is applied to the structure by a moving ice mass as compared to a cylindrical shaped stage. This results because the angles provided by the octagon provide a smaller contact area for a moving ice mass than the rounded shape of a cylindrical.

The reduced contact area will cause the crushing distance of the impinging ice mass against structure 11 to be greater, and thereby reduce the maximum load applied to structure 11.

Figure 2:
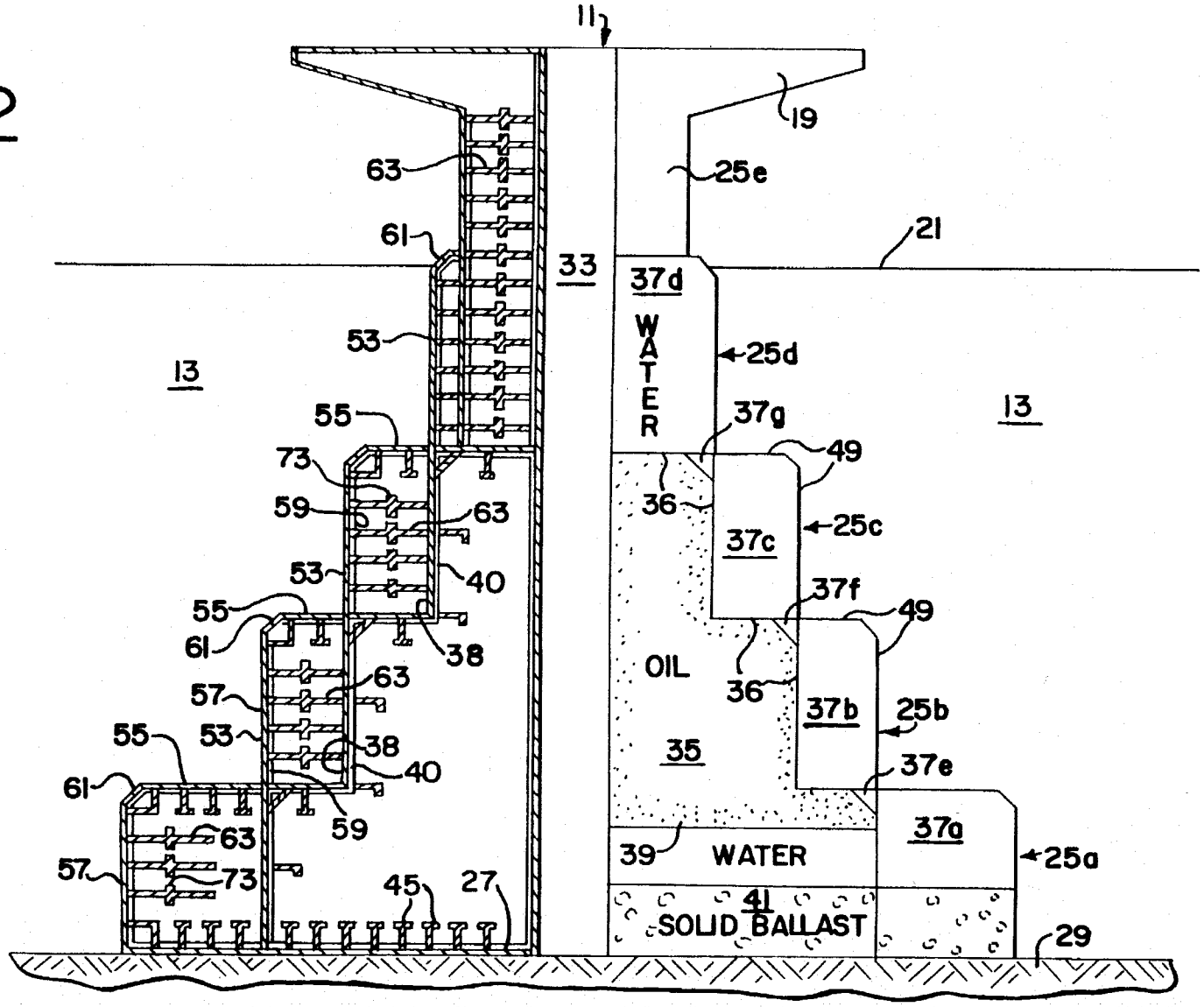
FIG. 2 is a composite cross-sectional side view of the structure of FIG. 1 showing structural details on the left side and storage details on the right side.
Figure 3:
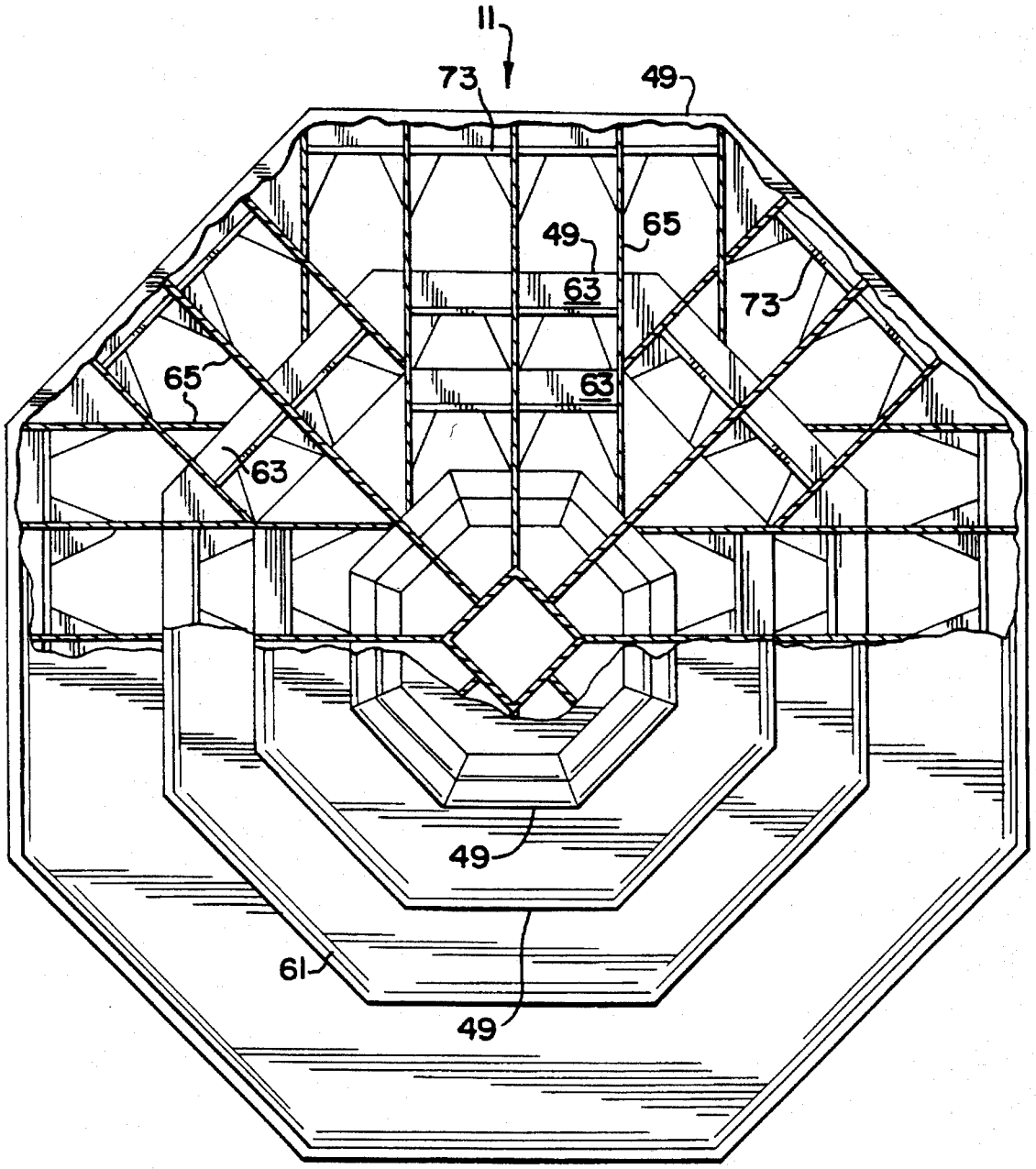
FIG. 3 is a composite cross-sectional plan view showing structural details for each stepped stage. The bottom half of FIG. 3 shows the outer hull of the stepped stage gravity structure.
Figure 4:
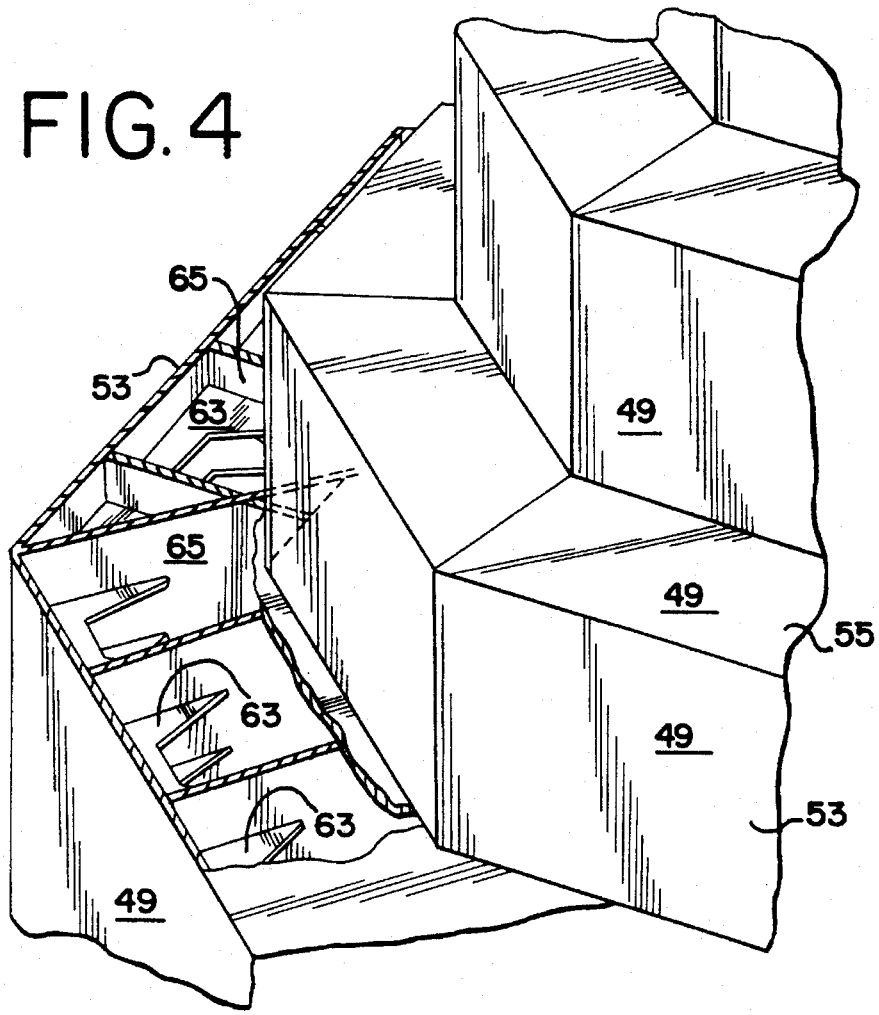
FIG. 4 shows a cut-away view of one stepped stage of the structure of FIG. 3.

Turning now to FIG. 2, centrally located within structure 11 is a moon pool 33 through which the majority of any drilling operations are carded out. A cross-sectional view showing details of an oil storage enclosure 35 and a water buffer 37 are shown to the night of moon pool 33. Oil storage enclosure 35 preferably is a wet-type storage enclosure. With a wet-type storage enclosure, enclosure 35 is always filled with either water or crude oil. Initially, storage enclosure 35 is filled with water; as crude oil is recovered, it is pumped into storage enclosure 35 and water present within enclosure 35 is expelled. This will cause an oil-water interface 39 to move downward as crude oil is pumped into enclosure 35. Preferably, located beneath oil storage enclosure 35 is solid ballast region 41. The solid ballast located within region 41 helps maintain structure 11 stable on sea floor foundation 29.

Inner hull 36 preferably forms at least part of the outer boundary of oil enclosure 35. Inner hull 36 preferably is comprised of steel plates 38 and stiffeners 40.

Water buffer 37 is comprised of several regions 37*a–g*. Water buffer 37 provides a buffer between oil storage enclosure 35 and the surrounding ocean or sea. Preferably, buffer regions 37*a, b*, and *c* are at least ten (10) meters across. This will help prevent any possible seepage of crude oil from storage enclosure 35 to the surrounding ocean or sea.

Oil storage enclosure 35 preferably does not extend to the waterline 21. Instead, near waterline 21, moon pool 33 is preferably surrounded by water buffer region 35*d*. This will minimize the chance that moving ice masses 15 (not shown in FIG. 2) or ships impinging on structure 11, near waterline 21, could cause crude-oil to spill from oil storage enclosure 35 to the surrounding ocean waters.

Referring now to FIGS. 2 through 5 and 7, the structural details which are preferably utilized in structure 11 are shown. Structure 11's foundation base 27 is strengthened by girders 45 which are attached to the inner surface of foundation base 27 and run circumferentially around foundation base 27. Foundation base 27 is also preferably strengthened by stiffeners (not shown in the FIG's), which are attached to foundation base 27, preferably at its inner surface, and run radially outward from moon plot 33 to the outer edge of base 27. Both girders 45 and the stiffeners are preferably welded to foundation base 27.

As discussed earlier, substructure 23 is comprised of at least three stepped stages 25 (*a, b, c, d*, and *e* shown). Each of these stages has an outer hull 49, which acts as the main barrier against water waves and moving ice masses. Outer hull 49 must be able to withstand the Environmental Loads which act locally on outer hull 49. One of the most significant of these Environmental Loads is the local ice load which can result from an iceberg colliding with structure 11. The local ice load can be calculated by a statistical probability analysis described briefly above. Outer hull 49 preferably is designed to withstand a 10-year design local ice load, more preferably a 100-year design local ice load.

Outer hull 49 is comprised of vertical walls 53 and top walls 55. Preferably, top wall 55 has a beveled edge 61, which is connected to vertical wall 53. Walls 53 and 55 are comprised of steel plates 57, which preferably are welded together to form one continuous water tight boundary, and stiffeners 59, which preferably are welded to the inner surface of plates 57. Plates 57 preferably are from 20 to 40 millimeters thick, more preferably 25 to 35 millimeters thick, most preferably 30 millimeters thick. Plates 57 are preferably constructed of arctic grade steel, such as grade EH 36.

Walls 53 and 55 preferably are designed to take advantage of the in-plane tension Which can result when a continuously supported plate is acted on by an external force, such as the; local ice load which results when a moving ice mass collides with structure 11. When in-plane tension is created within steel plates 57, the plates take the shape of a catenary. A system which is exhibiting catenary action typically can withstand a larger external force than would be expected if catenary action was not present.

Figure 7:
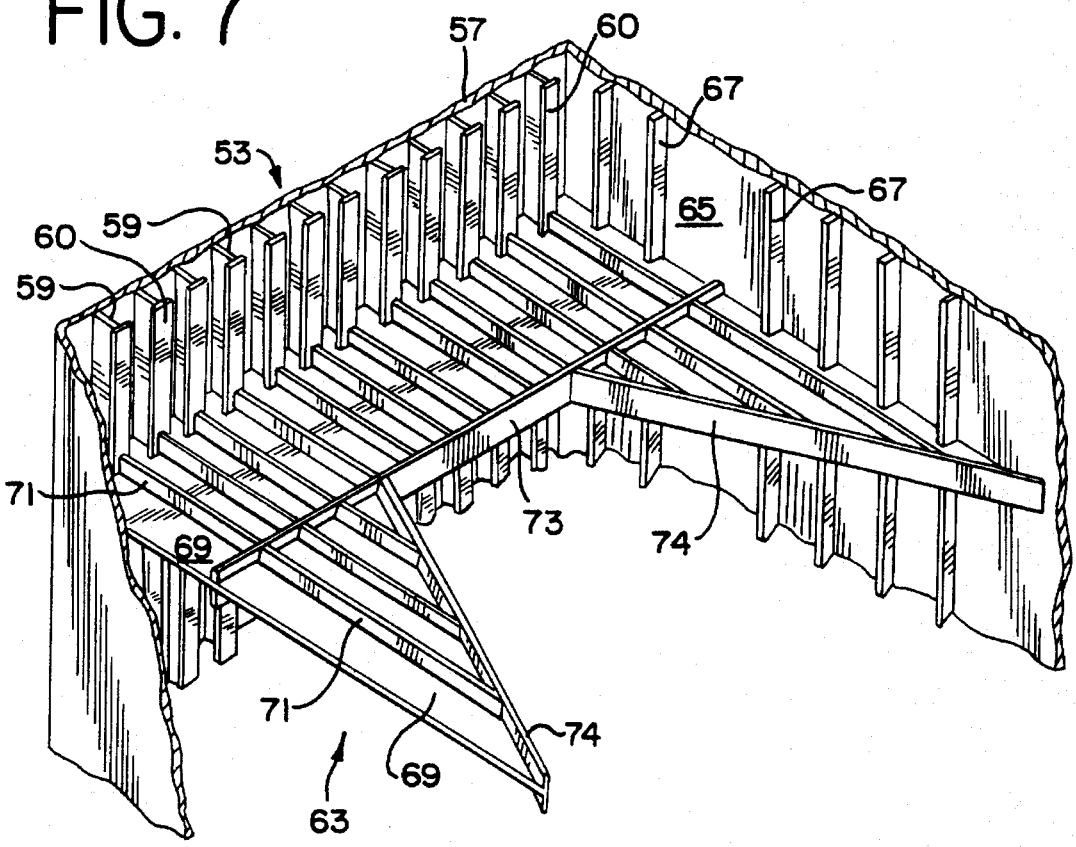
FIG. 7 is a perspective view showing in more detail the outer hull and adjacent structural details.
Figure 7A:
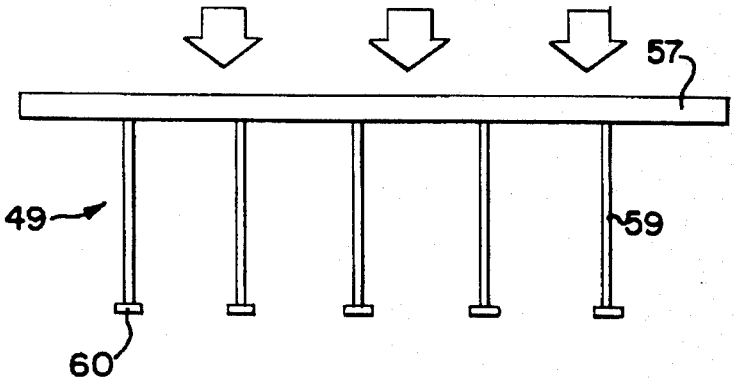
FIG. 7A is a schematic representation of the relative size relationships for the components which comprise the outer hull of a stepped stage gravity structure which is not designed specifically to take advantage of catenary action.
Figure 7B:
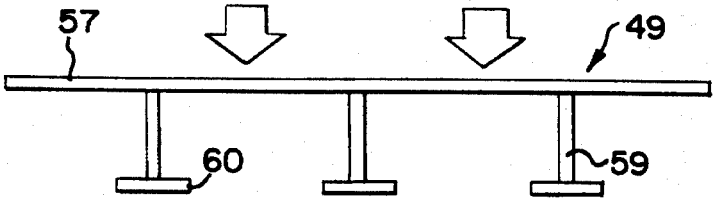
FIG. 7B is a schematic representation of the relative size relationships for the components which comprise the outer hull of a stepped stage gravity structure which is specifically designed to take advantage of catenary action.

FIG. 7A shows an outer wall design which is not designed to take advantage of catenary action. FIG. 7B shows the preferred design utilized for outer walls 53 and 55 which are designed to take advantage of catenary action.

In the preferred design, steel plate 57 is relatively thinner than the plating used in the design shown in FIG. 7A. In addition, stiffeners 59 relatively are not as deep and are stockier than the design shown in FIG. 7A. Further, the preferred design, for walls 53 and 55, utilizes crosspieces 60, which are relatively larger than the crosspieces used in the design shown in FIG. 7A. In the preferred design these changes will result in walls 53 and 55 which have a steel plate span to depth ratio in the transverse direction that is larger than in the wall designs shown in FIG. 7A. In general, the preferred design will cause walls 53 and 55 to exhibit catenary action when a large moving ice mass impinges against structure 11. This catenary action and the overall design will result in in-plane tension being developed within steel plates 57. This will allow relatively less steel to be utilized in building structure 11. A more detailed description of catenary action and how it can be used to design structure 11 can be found in John Fitzpatrick, "State-Of-The-Art of Bottom-Founded Arctic Steel Structures," a paper published May 16, 1994, describing a presentation made at the Ice Technology Conference held in Calgary, Canada on Mar. 16, 1994, which is hereby incorporated by reference for its discussion relating to catenary action in a continuously supported plate.

Stiffeners 59 preferably run vertically on vertical wall 53 and horizontally on top wall 55. Stiffeners 59 form a rib-like structure within each stepped stage 25*a, b, c*, and *d*. Stiffeners 59 will spread the Environmental Loads, which result from moving ice masses and water waves impinging on outer hall 49, across the vertical expanse of vertical wall 53. Also, a moving ice mass is more likely to contact a greater number of stiffeners 59, if they run vertically on vertical wall 53. Further, the vertical alignment of stiffeners 59 facilitates the transfer of an overturning moment, which results from ice masses or water waves impinging on structure 11, to sea floor foundation 29.

Girders 63 preferably are welded to vertical walls 53 and top walls 55. Girders 63 transfer the shear forces, which result from the impingement of water waves and moving ice masses on outer hull 49 to vertical bulkheads 65. Vertical bulkheads 65 extend from the inner surface of foundation base 27 to the inner surface of outer hull 49 and form a web-like structure which transfers Environmental Loads to sea floor foundation 29. Vertical bulkheads 65 also support the weight of structure 11. Stiffeners 67, which are preferably welded to bulkheads 65, run vertically on bulkheads 65. These stiffeners strengthen bulkheads 65 so that they do not buckle as a result of downward acting loads, such as the loads which result from an overturning moment.

Figure 5:
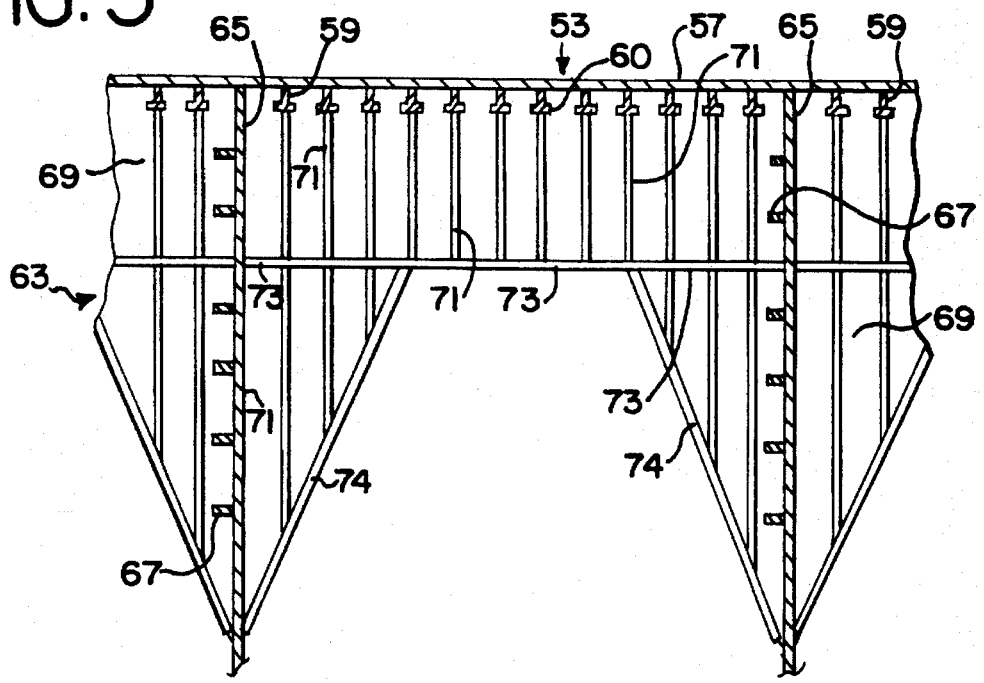
FIG. 5 is a plan view showing in more detail the outer hull and adjacent structural details.

Now referring to FIGS. 5 and 7, a preferable arrangement of girder 63 with respect to outer hull 49 and bulkheads 65 is shown in more detail. Girder 63 preferably is constructed of flat steel plates 69, stiffeners 71, and flange 73. Plate 69 is preferably constructed of 30 to 50 millimeters thick arctic grade steel. Stiffeners 71, which are typically attached to plate 69's upper and lower surface, strengthen girder 63 to prevent it from buckling from the shear forces which result from water waves and moving ice masses impinging on outer hull 49. Flange 73 helps transfer shear forces, which result from water waves and moving ice masses impinging on outer hall 49, to edge pieces 74. Edge pieces 74 assist in transferring the shear forces to bulkheads 65. Flange 73 preferably extends 20 to 50 centimeters above and below plate 69.

Plate 69 preferably is wider in the horizontal plane where it attaches to bulkheads 65. This type of design saves weight, while at the same time providing extra material for additional strength where the shear forces will be the greatest.

Preferably, all the components which make up girders 63 are welded together for greater strength. Additionally, girders 63 preferably are welded to outer hull 49 and to bulkheads 65.

EXAMPLE

This Example shows that an offshore structure that uses a stepped stage design, as described herein, will reduce the wave load per vertical meter run of the structure and therefore will reduce the total Environmental Load which will act on the structure due to a design water wave impinging on such a structure. This can facilitate the construction of a structure which requires less material and which can be constructed at a substantially lower overall cost than traditional offshore structures that have to withstand moving ice masses.

Figure 6:
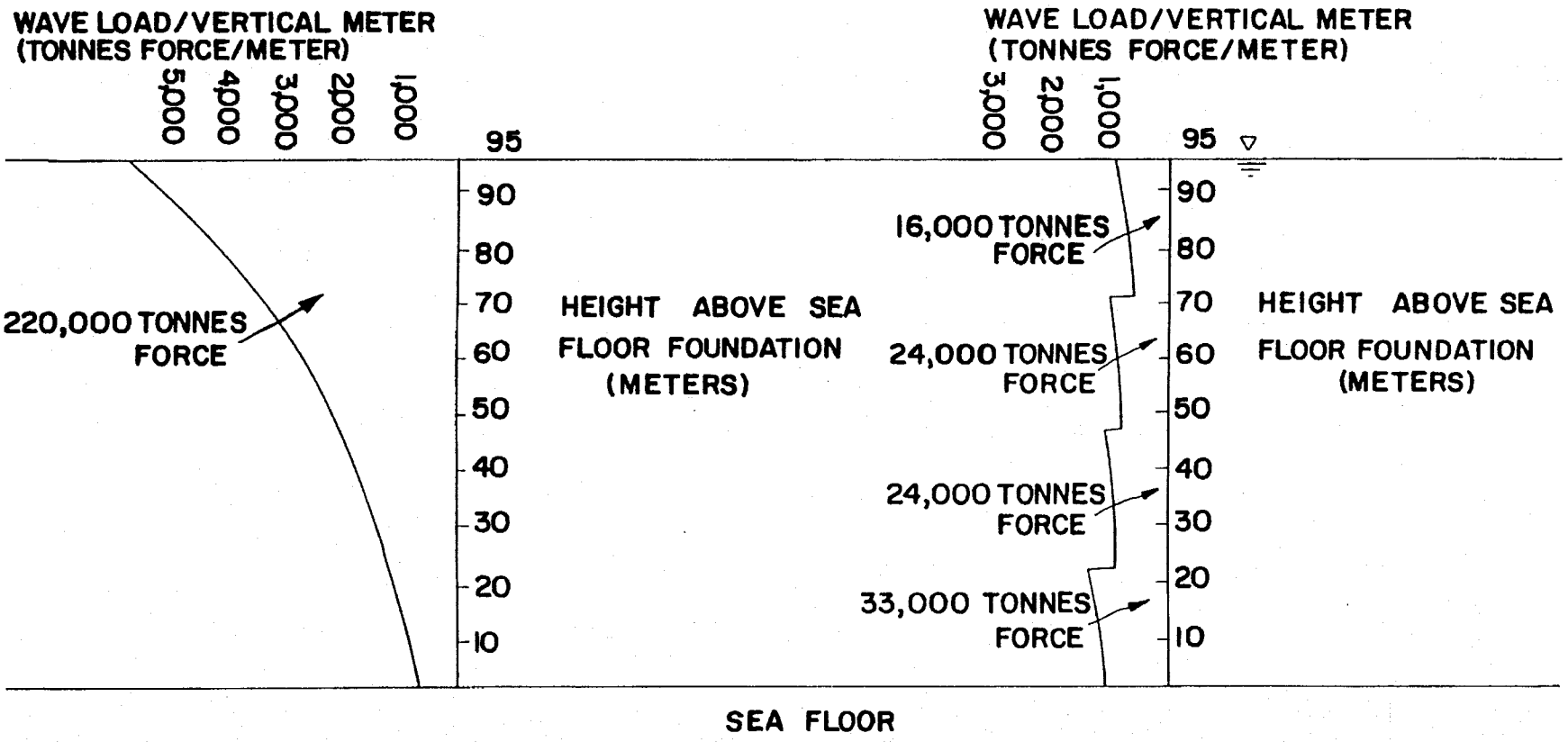
FIG. 6 is a graph that shows the Environmental Loads which would result if a 100-year design water wave impinged on one embodiment of the stepped staged gravity structure of FIG. 1.

Referring to FIG. 6, FIG. 6 compares the wave load per vertical meter run that acts on stepped stage gravity structure 11 as depicted in the FIGS. to the wave load per vertical meter run that acts on a cylindrically-shaped structure. For this Example, it was assumed that both structure 11 and the cylinder were located in ninety five (95) meter deep water. It was assumed that the 100 year design ice load for the region was 90,000 tonnes force (from a 4,000,000 tonne iceberg.) The overturning moment which would be applied to sea floor foundation 29 by such an iceberg is 6,300,000 tonnes force meter. The wave load per vertical meter run relationships for each structure were calculated using a 100 year design water wave with a maximum height of 30 meters and a wavelength of 350 meters.

In general, the wave load per vertical meter run for a particular depth of water is proportional to the square of the outer diameter for a large diameter structure. A more complete discussion of how to calculate the wave load acting on a structure can be found in Michael Isaacson, Chapter 6, "Wave Forces on Large Bodies," *Mechanics Of Wave Forces On Offshore Structures*, Van Nostrand Reinhold Co., (New York 1981).

The curve on the left of FIG. 6 is for a cylinder having an outer diameter of 105 meters. The curve on the right is a composite curve showing the wave load per vertical meter acting on structure 11 as shown in FIG. 1. In developing FIG. 6 it was assumed that stage 25*a* had an outer diameter of 125 meters; stage 25*b* had an outer diameter of 87 meters; stage 25*c* had an outer diameter of 64 meters; and stage 25*d* had an outer diameter of 40 meters. Stage 25*e*, which was assumed to have an outer diameter of 32 meters, was not included in FIG.6 because the wave load acting on stage 25*e* will be roughly 90° out of phase with the wave load acting on stages 25*a–d*. Therefore, the wave load acting on stage 25*e* will not contribute significantly to the total Environmental Load acting on the structure as a result of a 100 design water wave impinging on structure 11.

The total Environmental Load can be found from the total area to the right of the curves. For the cylinder having a 105 meter outer diameter, the total Environmental Load which results from the 100 year design water wave was 230,000 tonnes force. For structure 11, the total Environmental Load which results from the 100 year design water wave was 100,000 tonnes force. Of this total Environmental Load: 33,000 tonnes force resulted from the wave's action on stage 25*a*; 24,000 tonnes force resulted from the wave's action on stage 25*b*; 24,000 tonnes force resulted from the wave's action on stage 25*c*; and 16,000 tonnes force resulted from the wave's action on stage 25*d*.

The overturning moment which would be applied to sea floor foundation 29, as a result of the 100 year design water wave impinging on structure 11, is 5,000,000 tonnes force meter. This is a much smaller overturning moment than would result for a cylinder having an outer diameter of 105 meters, which is located in the same location. Additionally, a stepped stage design reduces the twisting moment which would be applied to sea floor foundation 29 if an iceberg or other large moving ice mass impacted with structure 11 near the waterline.

It should be appreciated that various other embodiments of the invention will be apparent to those skilled in the art through modification or substitution without departing from the spirit and scope of the invention as defined in the following claims.

I claim:

1. An offshore structure for placement on a sea floor foundation in a body of water containing moving ice masses and water waves, which impart Environmental Loads to the structure, comprising:

a foundation base which contacts the sea floor foundation, the foundation base having sufficient horizontal cross-sectional area such that a bearing pressure and a horizontal shear force, which result from the Environmental Loads and which are transferred to the sea floor foundation by the foundation base, are less than at least one of a predetermined shear capacity and a predetermined bearing capacity for the sea floor foundation; and at least three stepped stages stacked above the foundation base, each stage having an outer hull to engage the ice masses, the outer hull for each stage being comprised of a substantially vertical wall and a top wall connected to the substantially vertical wall, and each stage having a smaller outer diameter than the stage immediately below it, the structure having a sufficient mass to prevent an overturning moment, which results form the Environmental Loads, from overturning the structure.

2. The structure of claim 1, further comprising solid ballast contained within a lowermost stage of the at least three stepped stages.

3. The structure of claim 1, wherein the foundation base is formed by a lower end of a lowermost stage of the at least three stepped stages.

4. The structure of claim 1, wherein the Environmental Loads result from at least one of a 100 year design moving ice mass and a 100 year design water wave.

5. The structure of claim 4, wherein the 100 year design moving ice mass comprises an iceberg capable of imparting a 90,000 tonne force Environmental Load to the structure.

6. The structure of claim 1, wherein the at least three stepped stages are sized such that a water wave imparts a first average wave load per vertical meter run to the outer hull of a first stage which is approximately equal to a second average wave load per vertical meter run to the outer hull of a second stage which is located below the first stage.

7. The structure of claim 1, further comprising a first deck located above the waterline which is supported by an uppermost of the at least three stepped stages.

8. The structure of claim 7, further comprising a second deck located above the first deck.

9. The structure of claim 1, wherein the outer hull for each stage is further comprised of:

stiffeners running vertically along the substantially vertical wall and horizontally along the top wall.

10. The structure of claim 9, wherein the top wall for a stage has a beveled edge connecting the top wall to the substantially vertical wall.

11. The structure of claim 1, wherein the outer hull is comprised of:

steel plates welded together to form a continuous water tight boundary; and stiffeners welded to the inside surface of the steel plates.

12. The structure of claim 11, wherein the outer hull is designed to cause catenary action within the steel plates when a large moving ice mass impinges against the outer hull.

13. The structure of claim 1, further comprising:

a moon pool through which drilling operations are conducted;

an oil storage enclosure surrounding the moon pool for storing crude oil; and a water buffer located between the oil storage enclosure and the outer hull, the water buffer providing about ten meters of buffer space between the outer hull and the oil storage enclosure.

14. The structure of claim 13, wherein the oil storage enclosure is a wet-type storage enclosure.

15. The structure of claim 1, wherein a horizontal cross-section for at least one of the stages forms an octagonal shape.

16. A stepped stage gravity platform for placement on a sea floor foundation in a body of water containing moving ice masses and water waves, comprising:

a deck located above a waterline of the body of water; and a floatable substructure for supporting the deck, the substructure comprising at least three stepped stages including:

a lowermost first stage having an outer diameter of from about 100 to about 150 meters and having a lower end forming a foundation base, which contacts the sea floor foundation;

a second stage stacked above the first stage, the second stage having an outer diameter of from about 20 to about 50 meters less than the outer diameter of the first stage; and a third stage stacked above the second stage, the third stage having an outer diameter of from about 10 to about 30 meters less than the outer diameter of the second stage;

wherein each stage has an outer hull comprised of steel plates, and wherein the outer hull is designed to cause catenary action within the steel plates when a large moving ice mass impinges on the outer hull.

17. The platform of claim 16, wherein each stage is further comprised of:

an inner hull which forms an outer boundary of an oil storage enclosure; and a water buffer region located between the outer hull and the inner hull.

18. The platform of claim 16, wherein the platform is to be placed in 75 to about 130 meter deep water containing moving ice masses and water waves, which impart Environmental Loads to the platform, the Environmental Loads which can be imparted to the platform include a 100 year design global ice load, a 100 year design local acting ice load and a 100 year design water wave load.

19. The platform of claim 18, further comprising:

a fourth stage stacked above the third stage, the fourth stage having an outer diameter of from about 10 to about 30 meters less than the outer diameter of the third stage; and a fifth stage stacked above the third stage, the fifth stage having an outer diameter of from about 5 to about 15 meters less than the outer diameter of the fourth stage and from about 15 to about 65 meters less than the outer diameter of the deck.

20. The platform of claim 16, wherein the outer hull for at least one of the stages further comprises:

stiffeners welded to the inner surface of the steel plates, the stiffeners being arranged to form a vertically aligned rib-like structure supporting the outer hull.

21. An offshore structure for placement on a sea floor foundation in a body of water containing moving ice masses and water waves, comprising:

a foundation base which contacts the sea floor foundation; and stepped stages stacked above the foundation base, each stage having an outer hull to engage the ice masses, and each stage having a smaller outer diameter than the stage immediately below it;

wherein each stage has an the outer hull comprised of a substantially vertical wall and a top wall connected to the substantially vertical wall, the substantially vertical wall and the top wall being comprised of steel plates, and wherein the outer hull is designed to cause catenary action within the steel plates when a large moving ice mass impinges against the outer hull.

* * * * *